United States Patent [19]

Terzian

[11] 4,183,171

[45] Jan. 15, 1980

[54] CHANGEABLE FIGURE TOY

[75] Inventor: Rouben T. Terzian, Chicago, Ill.

[73] Assignee: Marvin Glass & Associates, Chicago, Ill.

[21] Appl. No.: 876,412

[22] Filed: Feb. 10, 1978

[51] Int. Cl.[2] ..... A63H 11/00

[52] U.S. Cl. ..... 46/119; 46/162

[58] Field of Search ..... 46/119, 151, 162, 161, 46/135 R, 141, 120; 35/17, 29 D

[56] References Cited

U.S. PATENT DOCUMENTS

| | | | |
|---|---|---|---|
| Re. 24,355 | 9/1957 | Whalen | 46/141 X |
| 2,154,121 | 4/1939 | Bold | 46/119 X |
| 2,548,237 | 4/1951 | Pearson | 46/120 |
| 2,551,433 | 5/1951 | Graves | 46/161 X |
| 2,572,795 | 10/1951 | Wood et al. | 46/141 |
| 3,812,613 | 5/1974 | Glass et al. | 46/119 |

*Primary Examiner*—Louis G. Mancene

*Assistant Examiner*—Mickey Yu

*Attorney, Agent, or Firm*—Mason, Kolehmainen, Rathburn & Wyss

[57] ABSTRACT

A changeable doll or figure toy which simulates pregnancy includes a generally hollow torso portion having an aperture generally in the area of the abdominal cavity directly below the bottom of the breast line. A movable cam member is pivotally mounted within the torso in a position generally adjacent the aperture. The cam member includes a curvilinear surface which protrudes through the abdominal aperture simulating pregnancy in one position and is retractable to a normal state. A bi-stable biasing spring is mounted within the torso and will maintain the cam member in either its extended or normal position. A second aperture in the rear of the torso permits engagement of the cam member or biasing spring to move the cam member forwardly to its extended position and the cam member is returned to its normal position by a force applied to the front thereof.

7 Claims, 4 Drawing Figures

10
12
14
16
18
20
22
26
28
30
32
34
35
36
38
38a
39
40
42
44
46
48
50
52
54
58
60
62
64

CHANGEABLE FIGURE TOY

BACKGROUND OF THE INVENTION

Field of the Invention

This invention relates to dolls and in particular to a doll having changeable features for simulating pregnancy and educational features. Recently, in the art relating to play and educational dolls, there have been an increasing number of dolls which are capable of simulating many different human activities such as eating, crying, playing various sports, and the like. In addition, in recent years there has been an increasing use of dolls in educational fields such as the popular, anatomically correct dolls.

These types of figure toys or dolls are especially popular in that the user may transpose himself into an adult stage by sharing activities with the doll during the functioning or simulated activities of the doll. The present invention provides a simplified, yet reliable, mechanism in a doll or figure toy for depicting pregnancy without the requirement of complex mechanisms. Related prior art dolls known to applicant includes the following: Graves, U.S. Pat. No. 2,551,433; Pearson, U.S. Pat. No. 2,548,237; Wood et al, U.S. Pat. No. 2,572,795; and Glass et al U.S. Pat. No. 3,812,613.

It is the object of this invention to meet the continuing need and desire in the art for improvements in changeable figure toys, educational toys, and dolls, by providing a doll which may undergo physical changes to simulate pregnancy.

An object of the present invention is to provide a new and improved figure toy or doll that is both entertaining and provides educational functions.

The best mode currently contemplated for carrying out the invention includes the provision of a doll or figure toy having a torso portion with an aperture generally in the abdominal position on the torso. A cam means is pivotally mounted within the torso and movable between a retracted position, in which the doll or figure toy assumes a normal or non-pregnant configuration and an extended or protruded position in which the cam means extends forwardly of the normal torso line providing the appearance of a large abdomen simulating pregnancy. A bi-stable biasing means within the torso maintains the cam means in either its normal or its extended position. A plurality of accessory items, including a bassinet, baby bottle, and the like are provided for use in combination with the changeable figure toy for either play or educational uses.

BRIEF DESCRIPTION OF THE DRAWINGS

The above and other objects and advantages and novel features of the present invention will become apparent from the following detailed description of a preferred embodiment of the invention illustrate in the accompanying drawings wherein.

DETAILED DESCRIPTION OF THE PREFERRED EMBODIMENT

Figures 1, 2, 3, 4:
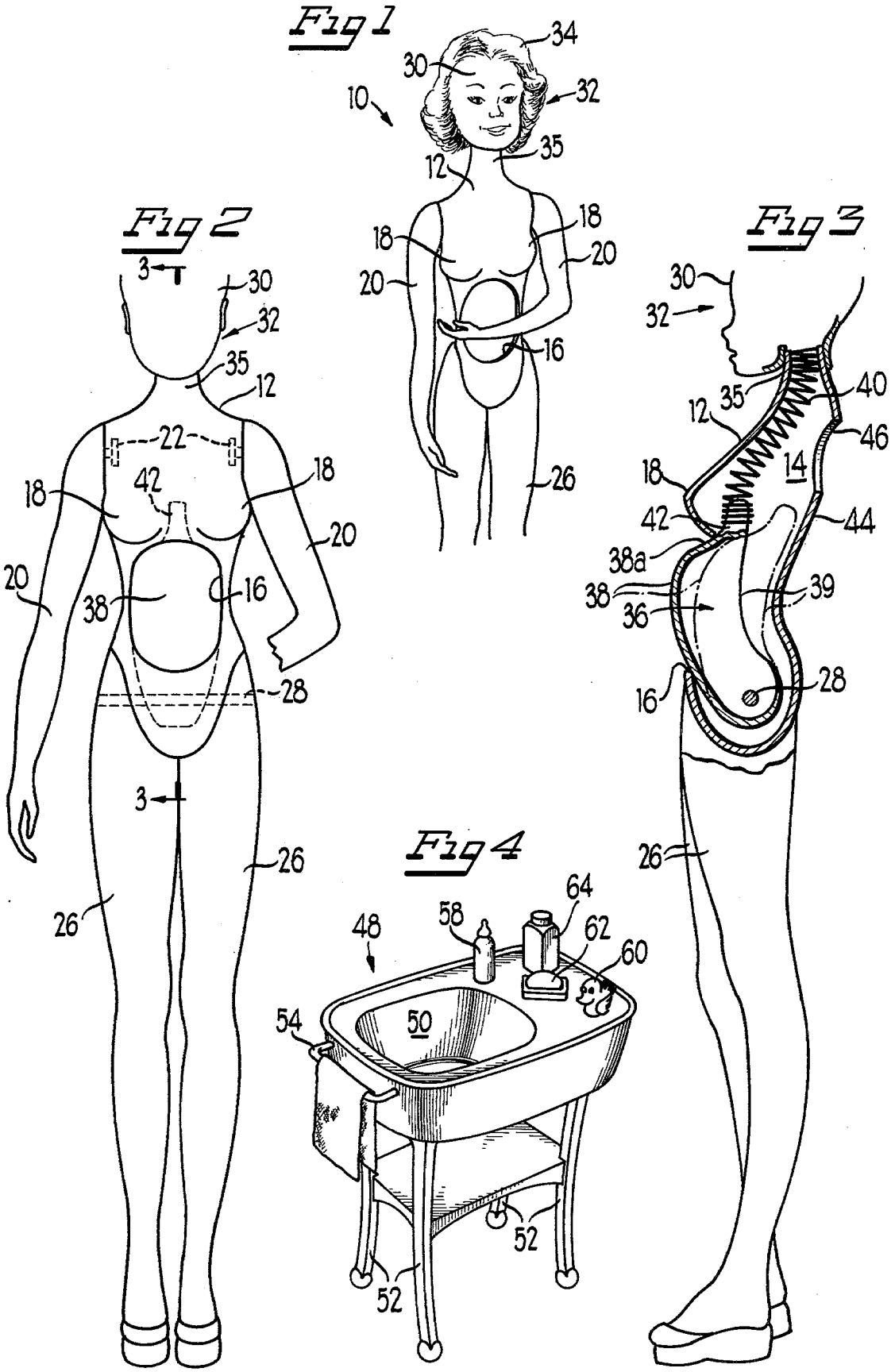
FIG. 1 is a front elevational view of a figure toy constructed in accordance with the principles of the present invention.
FIG. 2 is an enlarged, front elevational view of the figure toy of FIG. 1.
FIG. 3 is a partially fragmented vertical section taken generally along line 3—3 of FIG. 2.
FIG. 4 is a perspective view of a bassinet and accessory items which may be included with an educational doll as provided by the present invention.

Having reference now to the drawing, and initially to FIG. 1, there is illustrated a changeable or educational figure toy or doll, generally designated 10, constructed in accordance with the principles of the present invention. The doll is intended to be both entertaining and educational and is capable of simulating a change of state or physical characteristics to simulate pregnancy or a normal, nonpregnant state. The doll includes a torso portion 12 defining an internal chamber or open cavity 14. An aperture 16 is provided in the lower or abdominal area of the torso 12 extending substantially across the front of the torso and from just below the breast line defined by a pair of breasts 18 down to approximately the top of the hips. To further enhance the versatility, appearance, and educational aspects of the figure toy, a pair of arms 20 are pivotally mounted to the torso 12, generally in the area of the shoulders, in a manner well known in the art, such as by shoulder pins 22. In a similar manner, a pair of legs 26 are pivotally mounted to the bottom of the torso, generally in the area of the hips, by a transverse axle or pin 28. A head 30 including conventional facial features 32 and hair 34 is secured to the top of the torso 12 by a neck portion 35.

Cam means 36 is pivotally mounted within the interior of the torso 18 by the leg mounting pin 28 to provide the ability of the figure toy to simulate both the pregnant and non-pregnant state of an adult woman. The cam means 36 includes an arcuate or curvilinear front surface 38 and a similarly shaped rear surface 39 defining a hollow bulbous type member. The cam member is pivotally mounted for movement between two positions as shown in FIG. 3. In the forwardly extending or protruded position, as shown by solid lines in FIG. 3, the front surface 38 extends forwardly, to a position forwardly of the breasts 18 simulating the pregnant appearance of an adult female. In its retracted position, as shown by the phantom lines in FIG. 3, the front surface 38 of the cam member provides a generally flat surface generally along the contour lines of the remainder of the abdomen portion of the torso. The rear surface 39 of the cam member is curved to provide clearance in the area of the small of the back when the cam member is in its retracted position. The front curved surface 38 of the cam member includes, at its upper edge, a sharply angled surface **38*a* which meets the torso generally at the bottom of the breasts 18. This surface 38*a* provides a forward protruding area which will permit suitable maternity-type doll clothes to drape over the extending cam means very closely simulating a pregnant adult female. When in the retracted position, the angled surface 38*a* is generally within the torso so that the front surface portion 38*a*** of the cam member defines a generally flat abdomen corresponding to a non-pregnant adult woman.

Bi-stable biasing means, generally designated 40, is provided to maintain the cam means in either of its defined positions. The biasing means 40 is in the shape and form of a coiled spring and connected to an upper reduced neck portion 42 of the cam member. The opposite end of the spring 40 is secured, in the current embodiment, in the neck portion 35 of the torso. In the first stable position, the spring 40 biases the cam member toward its phantom position as shown in FIG. 3 where it will engage the interior of the back 44 of the torso. When it is desired to simulate pregnancy, the bi-stable spring 40 is moved to its second stable position, illustrated by solid lines in FIG. 3. A second aperture 46 in the shoulder area of the back of the torso permits insertion of a finger or other object to engage the spring member 40 thus pivoting the cam member forwardly. To move the cam member to its retracted position, slight pressure on the front surface 38 will overcome the biasing force and move the member to its retracted position. Alternatively, both the rear aperture 46 and the abdomen aperture 16 may be covered with resilient, yet flexible material such as plastic or rubber film while still permitting operation of the cam member as previously described. Alternatively, suitable doll clothing may be fitted to the doll to perform the same function.

To add enjoyment and educational value to the figure toy 10, a bassinet, generally designated by the reference numeral 48, may be included in combination therewith. The bassinet 48 resembles the type found in the home or hospital and includes a tub portion 50 mounted on legs 52 and may have a towel rack 54 and towel as well as other articles. Typically, the other articles include a baby bottle 58, a bath toy 60, a bar of soap 62, and a bottle of baby powder 64.

While only a single embodiment of the present invention has been shown, it will be understood that various changes and modifications may occur to those skilled in the art and it is contemplated by the appended claims to cover all such changes and modifications as fall within the true spirit and scope of the present invention.

What is claimed as new and desired to be secured by Letters Patent in the United States is:

1. A doll for simulating pregnancy, comprising:

a torso including a front abdominal opening;

limb members simulating arms and legs secured to said torso;

a head member secured to said torso;

a cam assembly mounted within said torso for simulating pregnancy upon actuation, said cam assembly including a cam pivotally mounted within said torso, said cam including a convex-shaped side portion position adjacent said opening; and a bi-stable spring positioned in the upper torso portion, said spring being secured to said cam assembly and accessible for manual actuation to move the cam from a first stable position maintaining said side portion within said opening to a second stable position maintaining said side portion in a position extending through said opening to thereby simulate pregnancy.

2. The doll claimed in claim 1 further comprising a second opening in the back of said torso to allow access to said spring for actuation to a selected stable position.

3. The doll of claim 2 including a second arcuate surface on said cam means opposite said first arcuate surface and complementary surface means on the back of the torso for surface interengagement therewith to define said first stable position.

4. The doll of claim 3 wherein said bi-stable biasing means comprises a spring secured to said cam means and to said torso.

5. The doll of claim 4 wherein said spring is mounted at a location on the torso relative to the pivot point of said cam means for providing maximum force at a point between said first and second positions thereof.

6. The doll of claim 1 further comprising a plurality of accessory items for use with infants.

7. The doll of claim 1 wherein one of said accessories is a bassinet including various cleansing items for an infant.

* * * * *